United States Patent [19]

Kordewick

[11] 4,000,590

[45] Jan. 4, 1977

[54] SECURITY GRILLE

[76] Inventor: Carl Kordewick, 490 Coronado Blvd., Universal City, Tex. 78148

[22] Filed: Aug. 4, 1975

[21] Appl. No.: 601,499

[52] U.S. Cl. ..... 52/106; 49/56; 52/663

[51] Int. Cl.[2] ..... E04H 3/08; E04C 2/42

[58] Field of Search ..... 52/106, 726, 660, 26, 52/663, 665, 507, 122, 127, 456; 49/57, 56; 16/176, 177

[56] References Cited

UNITED STATES PATENTS

| | | | |
|---|---|---|---|
| 1,799,308 | 4/1931 | Matthiesen et al. | 52/507 |
| 1,954,559 | 4/1934 | Crandall | 49/57 |
| 2,103,130 | 12/1937 | Windle | 52/660 |
| 2,117,950 | 5/1938 | Gibson | 52/665 |
| 2,303,718 | 12/1942 | Becker et al. | 49/57 |
| 3,032,777 | 5/1962 | Young | 16/176 |
| 3,340,661 | 9/1967 | Krieger | 52/507 |
| 3,398,491 | 8/1968 | Babcock | 52/90 |
| 3,848,918 | 11/1974 | Dyer | 16/176 |

*Primary Examiner*—Price C. Faw, Jr.
*Assistant Examiner*—Robert C. Farber
*Attorney, Agent, or Firm*—Pravel, Wilson & Gambrell

[57] ABSTRACT

A grille assembly readily mountable with a window frame for securing a window against unauthorized entry. The grille includes a plurality of horizontal members, each of which has longitudinally spaced, vertical openings. A plurality of vertical bars extend into the vertical openings of the horizontal members, and concealed mounting assemblies mount the horizontal members with the window frame.

7 Claims, 11 Drawing Figures

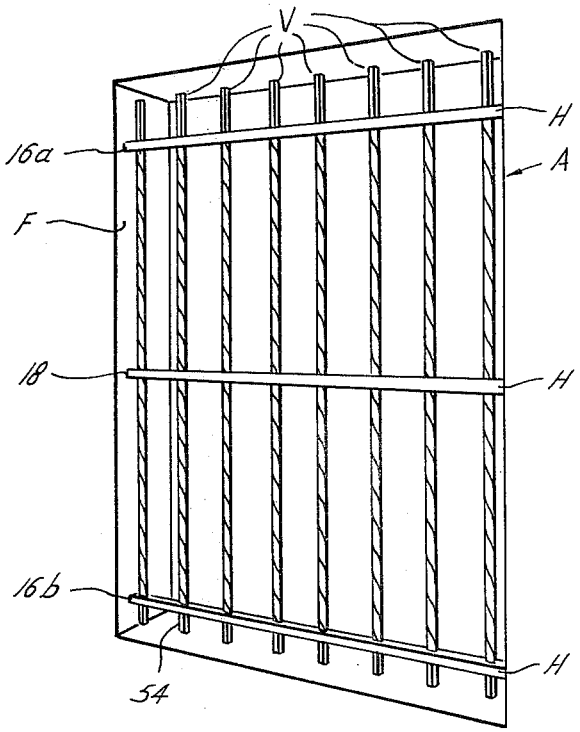
Fig. 1
Fig. 2
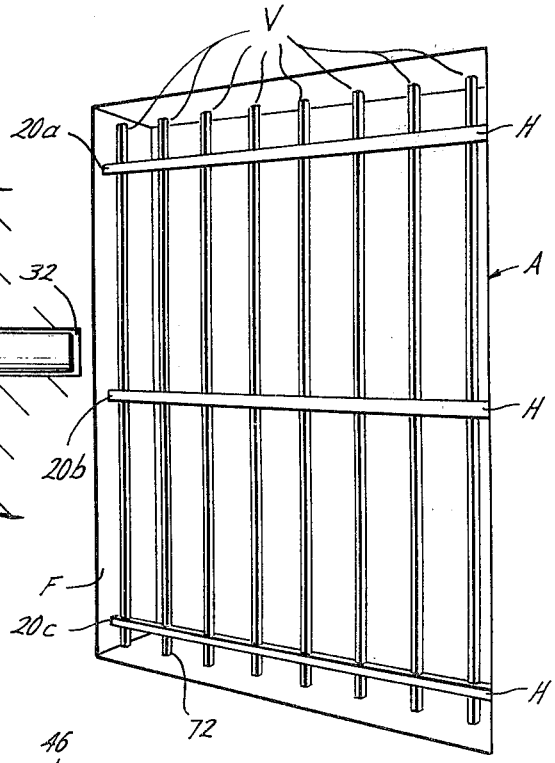
Fig. 3
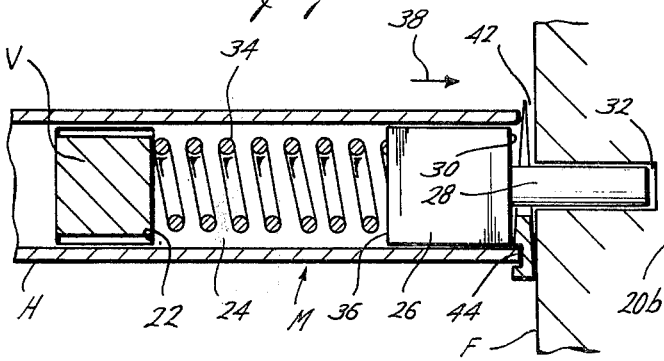
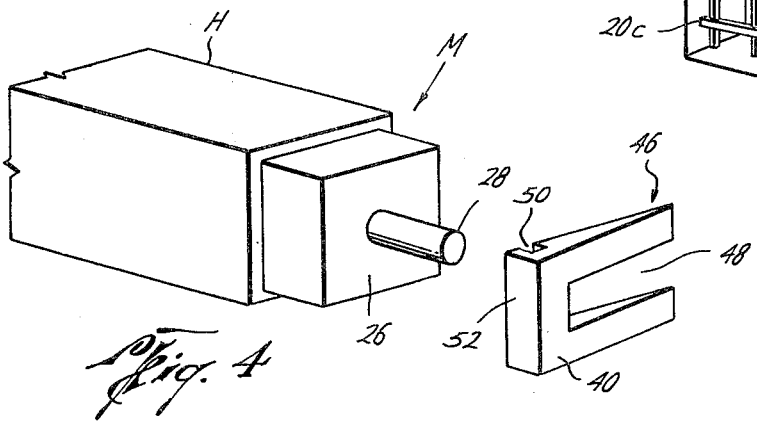
Fig. 4

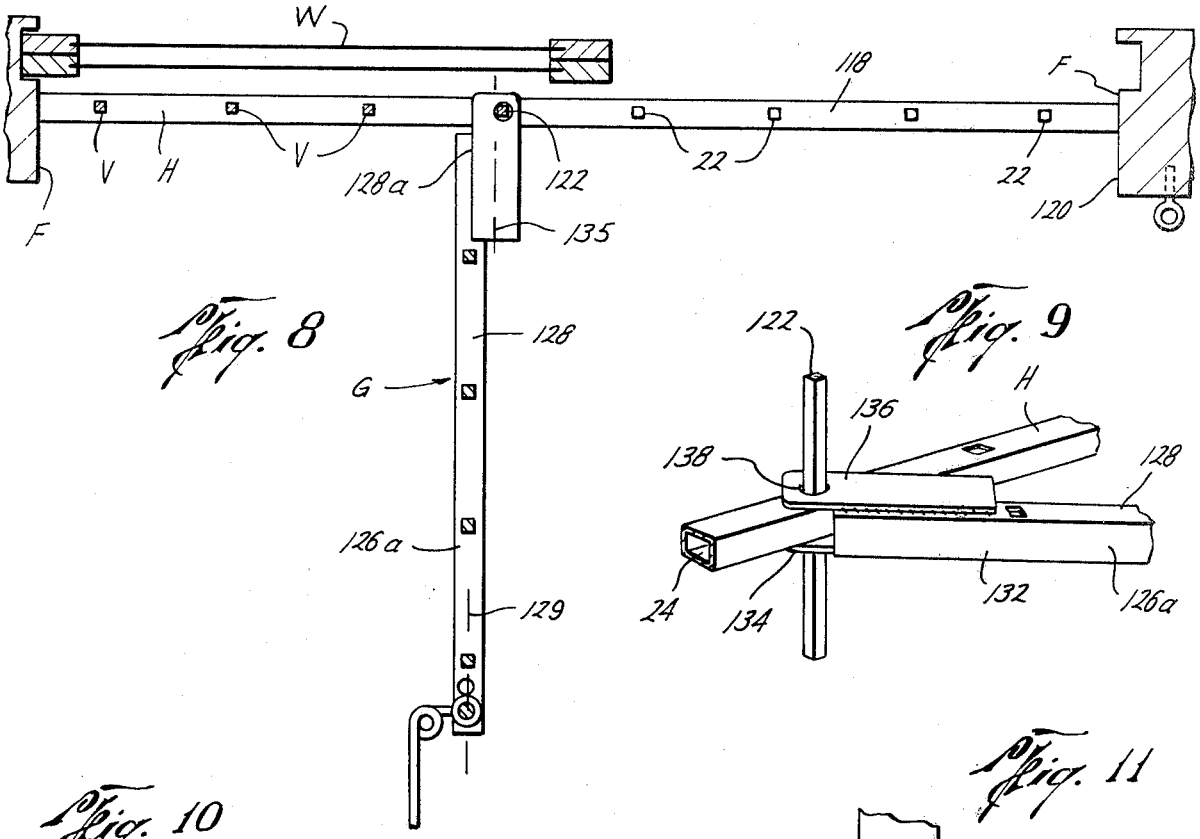
Fig. 8
Fig. 9
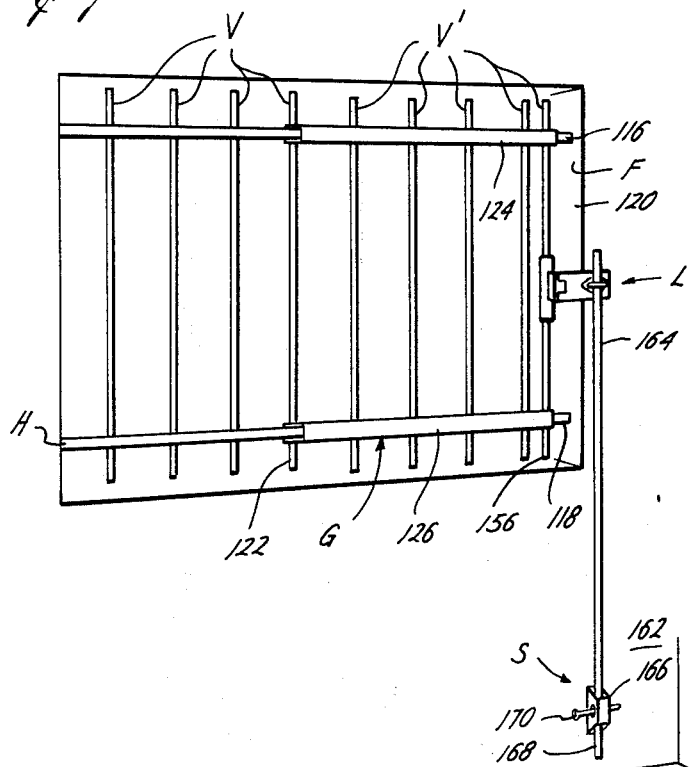
Fig. 10
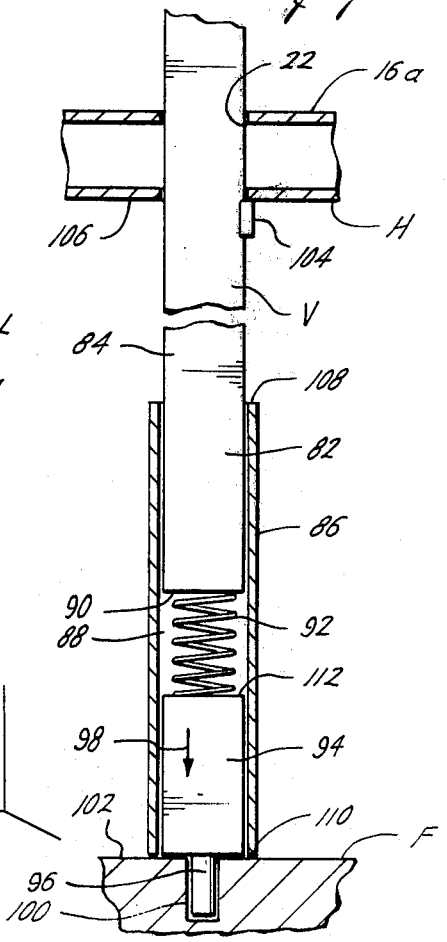
Fig. 11

SECURITY GRILLE

BACKGROUND OF THE INVENTION

The field of this invention is security grille assemblies and the like.

Known grille assemblies were used somewhat sparingly because of a variety of undesirable features associated with many such assemblies. For example, known grilles were often fully assembled before being brought to their installation site. The assembled grilles were, therefore, cumbersome and heavy and often could not be installed by a single man. Typically, the grilles were constructed so that they could be mounted only with one size window having a suitable framing for mounting the grille. This necessitated the manufacture and supply of several sizes of grilles and thus increased the cost to the ultimate user of the grille. Further, if the ultimate user had a peculiar size or shape window, it was necessary to have a grille custom built for that window.

Even known grilles which were assembled on site did not eliminate all the undesirable features of known grille assemblies. To assemble such grilles, it was often necessary to have welders and other metal working tools which a typical homeowner or other purchaser of the grilles did not have readily available. Again, it was often impossible for a single man to assemble and mount such grille assemblies, thus putting the purchaser of the grille to the expense of hiring qualified labor to install the grille. Further, many such grilles were constructed for mounting on the outside of the window. The grilles often had to be mounted in the crumbly mortar framing the exterior side of the window. Obtaining a suitable mounting in such a substance was often difficult if not impossible. If a secure mounting were not obtained in the mortar, of course, the grille could be easily removed and did not perform its function of securing the window against unauthorized entry. With such grilles, the mounting apparatus was often exposed to a potential intruder so that the grille could be relatively easily removed. Additionally, such grilles often made it impossible to install outside shutters over the windows, and many potential users of the grilles elected the aesthetically pleasing features of the outside shutters rather than such known grille assemblies.

SUMMARY OF THE INVENTION

It is an object of this invention to provide a new and improved grille assembly for securing a window against unauthorized entry.

The grille assembly of the present invention includes a plurality of horizontal members mounted with a window frame and a plurality of vertical bars mounted with the horizontal members to form a lattice-type structure effectively blocking entrance through a window.

Concealed mounting assemblies are received in a bore in each end of each horizontal member to firmly mount the horizontal members with the window frame. The mounting assemblies include a pin which is urged by resilient means into firm contact with a hole in the window frame. Because the mounting assemblies are housed principally in the horizontal members, they are concealed from a would be intruder and thereby discourage the intruder from attempting to tamper with the grille. Additionally, the mounting assemblies provide a connection between the window frame and the grille assembly which is much more secure than many of the mounting assemblies known in the prior art. The pin of the mounting assemblies extends into the window frame in a direction substantially parallel to the plane of the window. In order to remove the grille from the window frame, a would be intruder has to overcome either the shear strength of the window frame of the shear strength of the pin. Thus, even when the grille assembly of the present invention is mounted adjacent the exterior side of the window and the mounting assembly extends into mortar or other substances typically found on the exterior side of the window frame, the strength of the mounting of the grille to the window frame is increased over the strength of the mounting of many known grille assemblies.

Each of the horizontal members includes a plurality of longitudinally spaced, vertical openings formed in the horizontal member and extending through it. The vertical bars extend into these vertical openings of the horizontal members to restrain the vertical members against movement in all directions except the vertical. Further, since the vertical bars extend through the openings in the horizontal members, the vertical bars are readily secured against vertical movement by any of a variety of rather uncomplicated structures discussed in detail below. There is no need for the welding, cementing, or other laborious tasks often required for the assembly of known grille assemblies. Assembly and installation of the grille assembly of the present invention may be easily accomplished by a single person using only a few basic tools commonly found in the household.

The grille assembly of the present invention may also be provided with a gate or fire escape door to permit egress through the window in case of an emergency. The horizontal members and a vertical bar are mounted with the window frame in such a manner that an exit opening is formed adjacent the window. The gate is pivotally mounted on the vertical bar and supported by the horizontal members to swing between a closed position blocking the exit opening and an open position permitting egress through the exit opening. A latch is also provided to secure the gate in its closed position, and the latch is mounted in location so that it can be operated only by authorized personnel. Thus, the grille assembly of the present invention not only secures the window against unauthorized entry but also provides for the safety of the occupants of a building where the grille is employed by providing for egress through the window in case of an emergency.

BRIEF DESCRIPTION OF THE DRAWINGS

FIG. 1 is a perspective view of a first embodiment of the present invention mounted in a window frame.

FIG. 2 is a perspective view of a second embodiment of the present invention mounted with a window frame.

FIG. 3 is a cross-sectional view of a mounting assembly of the present invention.

FIG. 4 is an isometric view of the mounting assemblies of the present invention.

FIG. 6, FIG. 7, and FIG. 8 are top-sectional views of a third embodiment of the present invention which includes a fire escape gate.

FIG. 9 is a perspective view illustrating the mounting of the gate of the third embodiment of the present invention.

FIG. 10 is a perspective view showing the third embodiment of the present invention mounted with a window frame.

FIG. 11 is a sectional view illustrating structure for mounting the vertical bars of the grille assembly of the present invention.

DETAILED DESCRIPTION OF THE PREFERRED EMBODIMENTS

Figure 5:
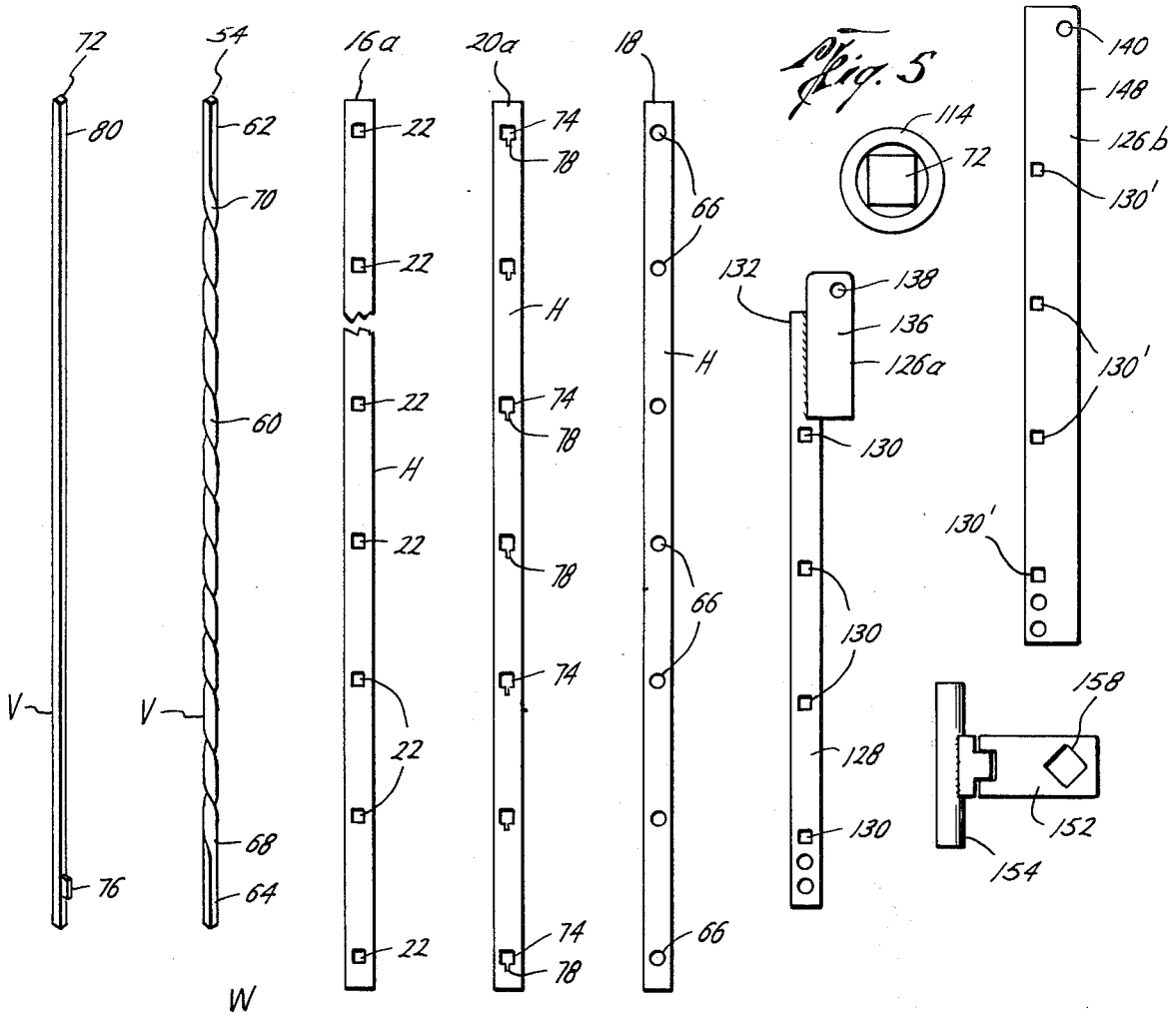
FIG. 5 is a plan view of various component parts which may be utilized to construct the grille assembly of the present invention.
Figure 6:
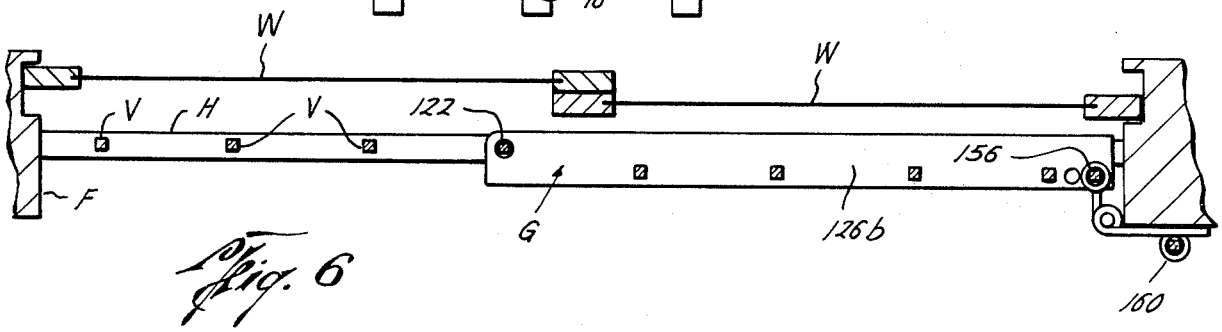

In the drawings, the letter A designates generally the grille assembly of the present invention which is readily mountable with a window frame F for securing a window W against unauthorized entry. The grille assembly A includes at least one and preferably a plurality of horizontal members H which are mounted with the window frame F by concealed mounting assemblies M. Vertical bars V extend through the horizontal members H and are mounted with the horizontal members to form a lattice-type structure adjacent the window W and secure the window W against unauthorized entry.

Considering the invention in more detail, FIG. 1 illustrates the grille assembly A in its mounted position. As illustrated, the grille A includes an upper horizontal member 16*a*, a center horizontal member 18, and a lower horizontal member 16*b* extending horizontally across the window frame F in a plane substantially parallel to the plane of window W. Each of the horizontal members H has a plurality of longitudinally spaced openings such as opening 22 extending through it. With the horizontal members H in their mounted positions, the openings extend vertically through the horizontal members H for receiving the vertical bars V as described in more detail hereinbelow. Preferably, the horizontal members H are tubes having square or rectangular cross sectional configurations as illustrated in FIGS. 4 and 9. While the horizontal members H need not be hollow throughout their entire length, it is desirable that each of the horizontal members has a bore 24 in each of its ends with the bore extending to the vertical opening nearest that end of the horizontal member. These bores 24 receive the mounting assemblies M which mount the horizontal members H on the window frame F.

The mounting assembly M includes a piston 26 which is slidably received in the bore 24 of the horizontal member H. A pin 28 formed on one end 30 of the piston 26 protrudes outwardly from the end 30 of piston 26 to extend into a hole or bore 32 formed in window frame F with a drill or other suitable means. A resilient means such as spring 34 engages an opposite end 36 of piston 26 and extends along the length of bore 24 to a vertical bar V extending through the vertical opening 22 nearest the end of horizontal member H. The spring 34 engages the vertical bar V and urges the piston 26 and pin 28 outwardly in the direction of arrow 38 to securely engage the pin 28 in the window frame bore 32 and thereby firmly mount the horizontal member with the window frame. With the horizontal members securely mounted and the vertical bars V extending through them, a rigid barrier is formed across the window frame F to secure the window W against unauthorized entry.

The mounting assembly M permits the grille A to be mounted in convenient locations on a large variety of types of window frames. Because the piston 26 in spring 34 are received in the horizontal members H and the pin 28 extends into bore 32 on the window frame, there is no need to find a large, substantially flat surface on the window frame F for mounting the grille assembly. So long as the window frame F has a surface which is wide enough to have a bore 32 formed in it, the grille assembly A may be mounted with the frame. Because of this, the grille assembly A may be used with a large variety of types of window frames. There are no mounting plates or the like which require wide, flat surfaces on the window frame F to rigidly mount the grille with the window frame F. Additionally, because of the relatively narrow surfaces on which the grille assembly A can be mounted, the grille generally offers no impediment to installing curtains on the inside of the window or shutters on the outside of the window.

It should also be noted that the mounting of grille A with the mounting assemblies M provides for a very secure mounting of the grille. Since the pins 28 extend into the window frame F along a plane substantially parallel to the window W, a would be intruder must overcome the shear strength of the pins 28 or the material from which the window frame F is made in order to remove the grille A.

Preferably, the grille assembly A is mounted on the inside or room side of the window W so that an intruder must break the window W in order to even gain access to the grille assembly A. This, of course, provides additional warning of a burglar and discourages the burglar from even attempting entry. When the grille assembly A is mounted on the outside of window W where crumbly mortar and the like frequently are found, the grille A can usually still be securely mounted. Because the pins 28 extend well into the window frame F and the shear strength of the mortar must be overcome to remove the grille A, the grille may be securely mounted in many materials which would not provide an adequate base for conventional mounting assemblies which employ screws, bolts, and the like.

Additionally, because the mounting assemblies M are slidably received in the bores 24, they are concealed from an intruder. While many conventional mounting assemblies had bolts and screws which were accessible to a would be intruder and by which the intruder could remove the grille assembly, the mounting means M is simply not visible or accessible to a would be intruder. Thus, the very construction of the grille assembly A deters an intruder from even attempting to tamper with the grille A. To even further discourage tampering, a wedge 40 may be utilized with the grille A. The wedge 40 is used to fill any gap or space 42 which might be left between an end 44 of the horizontal member and the window frame F. The wedge 40 has a narrow end 46 which is bifurcated so that pin 28 may be received in the slot 48 of wedge 40 when the wedge is placed between the horizontal member H and the window frame F. A groove 50 is formed near the wider end 52 of wedge 40 to receive end 44 of the horizontal member H and secure the wedge 40 in place. The wedge 40 is placed so that the wider end 52 of the wedge faces outwardly or away from the room having the window W. Thus, a would be intruder does not even see a gap between the horizontal member H and the window frame F to invite tampering with the grille assembly A. Rather, the would be intruder sees the broad end 52 of the wedge 40 making it difficult for him to tell how the grille A is mounted with the window frame and eliminating any gap which might be pried or otherwise utilized in tampering with the grille assembly A.

Preferably, the structure of the vertical bars V and horizontal members H is such that the vertical bars V engage the horizontal members H to restrain the vertical movement of the vertical bars and thereby securely position the vertical bars in their desired position across the window frame F. The grille assembly of the present invention includes several embodiments by which such engagement of the vertical bars V and horizontal members H is accomplished. A first such embodiment is illustrated generally in FIG. 1. The vertical bars 54 used in this first embodiment are shown in more detail in FIG. 5 as are the horizontal members H. Since the lower horizontal member 16*b* is preferably identical in structure to the upper horizontal member 16*a*, only the upper horizontal member 16*a* is illustrated in FIG. 5. However, the description of the upper horizontal member 16*a* is equally applicable to the lower horizontal member 16*b*.

As can be seen in FIG. 5, the horizontal member 16*a* has a plurality of openings 22 formed in the horizontal member and extending through it. Preferably, the openings 22 are square or rectangular in shape and extend vertically when the horizontal member is mounted with the window frame F. The vertical bar 54 is preferably a square or rectangular rebar having a twisted midportion 60. This twisted midportion 60 has a larger diameter than either the upper portion 62 or the lower portion 64 of the bar. The diameter of the upper and lower portions 62 and 64 of the vertical bar 54 are somewhat smaller than the openings 22 in the horizontal members 16*a* and 16*b*. Thus, the upper portion 62 of the vertical bars 54 can extend into the openings 22 of upper horizontal member 16*a* and through that horizontal member. Similarly, the lower portions 64 of vertical bar 54 can extend into the vertical openings 22 in the lower horizontal member 16*b* and through that horizontal member. However, the dimensions of the twisted midportion 60 of vertical bar 54 are sufficiently large to prevent the passage of the midportion through the openings 22 in either the upper horizontal member 16*a* or the lower horizontal member 16*b*. The dimensions of the twisted midportion 60 of vertical bar 54 are, however, sufficiently small to permit the midportion 60 to pass through openings 66 which are longitudinally spaced along the length of the center horizontal member 18 and extend through that horizontal member. Thus, in the embodiment of the present invention illustrated in FIG. 1, the lower portions 64 of the horizontal members 54 extend through the holes 22 in the lower horizontal member 16*b* and a lower portions 68 of the twisted midsection 60 contact the lower horizontal member 16*b* so that the lower horizontal member supports the vertical bar 54. The twisted midportion 60 of the vertical bar extends through the opening 66 in the center horizontal member 18, and the upper end portions 62 of the vertical bar 54 extend through the openings 22 of the upper horizontal member 16*a*. Should an upward vertical force be applied to the vertical bar 54, an upper portion 70 of the twisted midportion 60 engages the upper horizontal member 16*a* and prevent the vertical bar from passing through that horizontal member. Thus, in the first embodiment of the present invention the vertical bars 54 are supported by the lower horizontal member 16*b* and the vertical bars are restrained against vertical movement when in their mounted position extending through the horizontal members H.

A second embodiment of the grille assembly A which also provides for the desired engagement between the horizontal members H and the vertical bars V is illustrated generally in FIG. 2. The upper horizontal member 20*a*, the center horizontal member 20*b*, and the lower horizontal member 20*c* in this second embodiment are preferably identical in structure. Accordingly, only horizontal member 20*a* is illustrated in FIG. 5, but the description of the structure of horizontal member 20*a* is equally applicable to horizontal members 20*b* and 20*c* unless otherwise indicated. The vertical bars 72 of this second embodiment are also preferably identical in structure and only a single vertical bar 72 is illustrated in FIG. 5. As shown in that figure, the horizontal member 20*a* has a plurality of rectangular or square openings 74. The openings 74 are spaced longitudinally along the horizontal member 20*a* and extend through it. When the horizontal member 20*a* is in its mounted position with window frame F, the openings 74 extend vertically to receive the vertical bar 72. The vertical bar 72 has a substantially square or rectangular cross section throughout its length and has cross sectional dimensions sufficiently small to permit the vertical bar to pass through an opening 74 in horizontal member 20*a*. Additionally, the vertical bar 72 is provided with a key 76 which may be an integral part of the vertical bar 72 formed by punching the bar as the bar is being made. This provides a tempered protrusion or key on the vertical bar 72 which is quite strong. The key 76 has dimensions which are sufficiently small to permit the key to pass through slots 78 formed in the horizontal member 20*a*. Each slot 78 is contiguous to one of the vertical openings 74 through the horizontal member 20*a* so that when the key 76 is aligned with the slot 78 the vertical bar 72 may pass freely through the horizontal member 20*a*. However, when the key 76 is not aligned with the slot 78 in the horizontal member 20*a*, the key 76 engages the horizontal member and prevents a portion of the vertical bar 72 from passing through the horizontal member 20*a*. In the second embodiment of grille assembly A illustrated in FIG. 2, the upper and center horizontal members 20*a* and 20*b* are arranged so that the key 76 is aligned with the slots 78 in those members. However, the slots 78 in the lower horizontal member 20*c* are not aligned with the key 76 so that with the vertical bars in their position as illustrated in FIG. 2, the keys 76 of the vertical bars rest on the upper surface of lower horizontal member 20*c* and support the vertical bars in the grille assembly A. Thus, the vertical bar 72 may freely pass through the upper and center horizontal members 20*a* and 20*b* for assembling the grille A, but the keys 76 on the vertical bars 72 engage the lower member 20*c* to provide the support for the vertical bar 72.

Of course, it is well within the scope of the invention to provide the vertical bar 72 with a second key near an upper portion 80 of the vertical bar 72. The upper horizontal member 20*a* may then be arranged in the grille assembly A such that the slot 78 in the upper horizontal member are not aligned with the second key. During assembly, the upper horizontal member 20*a* may simply be slipped over the top of the vertical bars 72 so that the upper keys will engage the lower edge of the upper horizontal member 20*a*. With the use of the two keys, the vertical bars 72 are supported on the lower horizontal member 20*c* by the engagement of key 76 on the upper surface of the lower horizontal member. Movement of the vertical bar 72 upwardly is prevented by the engagement of the second key on the upper portion 80 of the vertical bar 72 against the lower surface of the horizontal member 20*a*.

An additional embodiment of the grille assembly A which provides for the engagement of the vertical bars V and the horizontal members H is illustrated generally in FIG. 11. In this additional embodiment of the grille A, a lower portion 82 of a vertical bar 84 is received in a sleeve 86. The sleeve 86 is preferably a rectangular or square tube similar in structure to the horizontal members H except that it has no openings extending laterally through it, but only a central longitudinally extending bore 88. The vertical bar 84 is similarly rectangular or square in cross section having dimensions sufficiently small to permit the sleeve 86 to slidably receive the vertical bar 84. A bottom end 90 of vertical bar 84 is engaged by resilient means such as spring 92 within the sleeve 86. The spring 92 additionally engages a sleeve piston 94 which is slidably received in the sleeve 86 and has a pin 96 protruding from it. The spring urges the piston 94 downwardly in the direction of arrow 98 to force the pin 96 firmly into a bore 100 formed in the lower portion or sill 102 of the window frame F. Additionally, the spring 92 urges the vertical bar 84 upwardly and forces a key 104 on the vertical bar 84 into firm engagement with a lower surface 106 of upper horizontal member 16*a*. Thus, the vertical bar 84 is mounted to prevent the vertical bar from being moved in an upward vertical direction. Additionally, the lower portion 82 of the vertical bar 84 is firmly mounted in the window sill 102 and held against downward movement by the spring 92. The vertical bar 84 is also firmly mounted with the window sill 102 to even more firmly secure the vertical bar against movement in any nonvertical direction. By mounting the vertical bar 84 with the window sill 102, the grille assembly A further discourages intruders from tampering with the grille A by clearly making it more difficult for any intruder to ever remove the grille A. This mounting of the vertical bar is even further protected against tampering by the fact that the sleeve 90 is sufficiently long to engage the lower horizontal member 16*b* (not shown in FIG. 11) before being raised a sufficient distance to expose the spring 92. That is, should an intruder raise the sleeve 92 upwardly along the vertical bar 84, an upper end 108 of the sleeve 92 engages the lower horizontal member 16*b* before the lower end 110 of the sleeve is raised above the upper end 112 of piston 94. Thus, even if an intruder were to raise the sleeve 92, only the piston 94 would be relatively accessible to the intruder. Since the pin 96 is not readily accessible to the intruder, it is difficult for an intruder to tamper with this mounting of the vertical bar 84.

An additional element which may be included with any of the described embodiments of the grille A to retain the vertical bars V in their desired positions with the horizontal members H is the friction washer 114 illustrated in FIG. 5. The friction washer extends around a vertical bar V and frictionally engages the sides of the bar with sufficient frictional force to support the vertical bar V. Additionally, the friction washer 114 has an outer diameter sufficiently large to prevent the washer from passing through any of the vertical openings in the respective horizontal members H. For example, friction washer 114 may be used with the second embodiment of the present invention by mounting the friction washer on an upper end 80 of the vertical bar 72. When the washer 114 is so mounted, it will resist upward movement of the vertical bar 72 by engaging a lower surface of the upper horizontal member 20*a* in case an upward vertical force is applied to that vertical bar. Additionally, friction washer 114 may be used with the second embodiment or other embodiments of the present invention by mounting the friction washer above the upper horizontal member. In this latter position, the friction washer 114 will engage the upper surface of the upper horizontal member and thus provide added support for the vertical bar.

As can be understood from the above description, the grille assembly A is both economical to manufacture and easy to install in a variety of window frames. The cost of manufacturing the grille assembly is low because very few types of components need to be manufactured for the complete grille assembly A. Further, the grille assembly A eliminates the need for assembling the grille during its manufacture. Rather, the components of the grille assembly A can be readily manufactured and sold as a kit to be installed by the prospective purchaser. The prospective purchaser can install the grille assembly A using a drill to form the required holes in the window frame F. In some cases where the window is of a peculiar size, a small hand saw to cut the vertical and horizontal members to the requisite size may be utilized. If desired, when selling the grille assembly as a kit, an adhesive strip with holes punched through it may be provided with the kit to give the prospective purchaser distances at which the holes for the mounting assemblies M should be drilled into the window frame F. The components of the grille assembly A can be handled individually and assembled together simply by sliding the vertical bars into the appropriate horizontal members. The keys, twisted midsections, and the like provided with the various embodiments automatically position the members together in the proper spacial relationship with one another. There is no need for welding, cementing, or other laborous and expensive tasks which the purchaser might not be willing to perform himself. Indeed, the grille assembly A provides a very economical and easy to install grille and, at the same time, provides a high degree of security against unauthorized entry through the window W.

In another embodiment of the present invention, the grille assembly A may be provided with a door or fire escape gate G to permit egress through the window W in case of an emergency such as fire. The gate G is pivotally mounted with the rest of the assembly A to swing between a closed position fully securing the window as illustrated in FIG. 10 and an open position allowing egress through the window as illustrated in FIG. 8.

In this fire escape embodiment of the present invention, an upper horizontal support member 116 and a lower horizontal support member 118 extend horizontally across the width of window frame F and are mounted with window frame F by the mounting means M. The horizontal support members 116 and 118 are preferably identical in structure to the horizontal members H previously described above. The horizontal support members H associated with any of the above described embodiments may be utilized. Additionally, vertical bars V are mounted with the horizontal support members 116 and 118 as described above with respect to the previous embodiments except that the vertical bars V are not positioned through all of the vertical openings in the horizontal support members 116 and 118. Rather, the vertical bars V are placed only part way across the lateral dimension of the window frame F. Some of the vertical openings in the horizontal support members 116 and 118 remain empty. By omitting some of the vertical bars V, an exit opening is formed adjacent the window W. The exit opening is bounded by the upper horizontal support member 116, and edge 120 of window frame F, the lower horizontal support member 118, and a vertical support bar 122.

The gate member G includes an upper horizontal gate member 124 and a lower horizontal support member 126. Each of the horizontal gate members 124 and 126 has a plurality of vertical openings extending therethrough to receive vertical gate members V'.

Preferably, the horizontal gate members 124 and 126 are identical in structure, although the present invention includes two embodiments of the horizontal gate members. These embodiments of the horizontal gate members are illustrated in FIG. 5 and identified by numerals **126*a* and 126*b*, respectively. The first embodiment of the horizontal gate members 126*a* includes a horizontal arm 128 having a plurality of openings 130 extending through the arm such that when the gate G is mounted with the grille assembly A, the openings 130 extend vertically. The vertical gate members V' are preferably identical in structure to the vertical bars V previously described above and are mounted with the horizontal gate members in such a manner that vertical movement of the vertical gate members with respect to the horizontal gate members is prohibited. As can be understood from the description of the embodiments discussed above, the vertical gate members V' may be mounted with the horizontal gate members 124 and 126** utilizing keys, friction washers, twisted midsections with enlarged diameters, and the like.

The first embodiment of the horizontal gate member **126*a* additionally has a pair of hinge plates 134 and 136 affixed to an end 132 of the horizontal arm 128. The hinge plates have aligned openings 138 in an uppermost corner to receive the innermost vertical bar 122 therethrough. Further, the hinge plates 134 and 136 are spaced apart a sufficient distance to extend on opposing sides of a horizontal support member as illustrated in FIG. 9. The upper horizontal gate member 124 is pivotally mounted with the inner vertical bar 122 and the upper horizontal support member 116 while the lower horizontal gate member 126 is mounted with the inner vertical bar 122 and the lower horizontal support member 118. These two pivotal connections firmly support the gate G for pivotal movement between its open position and its closed position. It should be noted that the hinge plates 134 and 136 are offset with respect to the horizontal arm 128 to allow full closing of the gate G. That is, the central longitudinal axis 135 of the plates is spaced from the central longitudinal axis 129 of arm 128 so that when the gate G is closed the ends 128*a* of the horizontal gate members do not prematurely contact the horizontal support members 116 and 118** to prevent proper closing of the gate.

Figure 7:
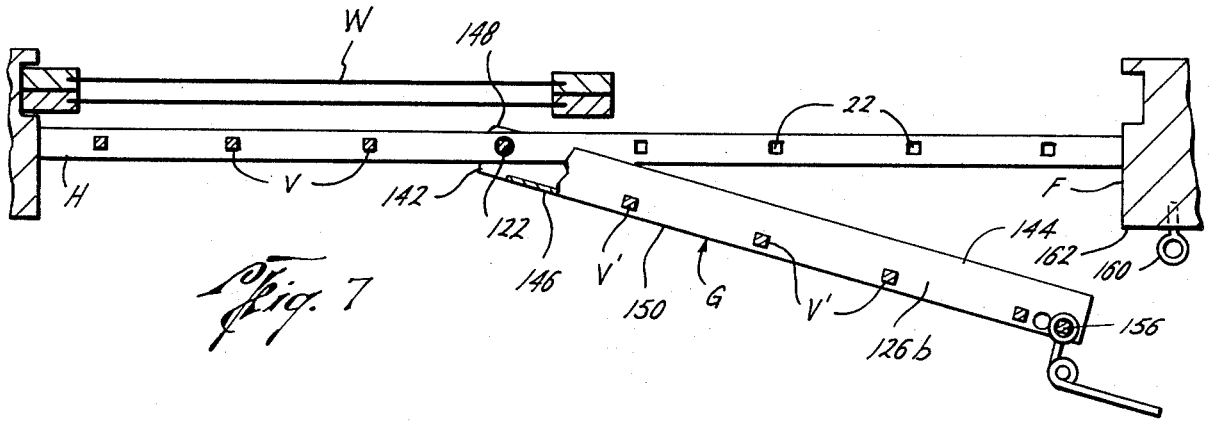

The second embodiment of the horizontal gate members **126*b* also provides for pivotal mounting of gate G with the horizontal support members 116 and 118 and the vertical support bar 122. The horizontal gate member 126*b* is preferably channel shaped and mounted with the grille assembly A such that the channel opens toward the horizontal support member 118. As illustrated in FIG. 7, the horizontal support member 126*c* includes a lower horizontal plate 142, an upper horizontal plate 144, and a vertical plate 146 joining the two horizontal plates 144 and 142. The gate member 126*b* has a pair of aligned openings 140 adjacent the inner side 148 of the member to receive the inner vertical support bar 122 on opposing sides of the horizontal support members so that the horizontal gate member may be pivotally mounted to move between its open and closed positions. The vertical openings 130 on the horizontal gate member 126*b* are positioned adjacent the outer edge 150 of the member to receive the vertical gate bars V' which are, of course, mounted between the horizontal gate members 124 and 126. By offsetting the vertical bars V' from the central longitudinal axis of the horizontal gate member 126*b*, the gate G is permitted to freely pivot between its open position and its fully closed position. Additionally, since the horizontal gate members 124 and 126 formed according to the embodiment identified by numeral 126*b* have a channel which opens towards the horizontal support members 116 and 118, the gate G gains added support from the horizontal support members 116 and 118 when the gate is in its fully closed position. That is, the upper plate 144 of the horizontal gate members 124 and 126 can rest on the upper surfaces of horizontal support members 116 and 118,** respectively, when the gate G is in its fully closed position.

To secure the gate G in its fully closed position, the grille A is provided with a latch means L. The latch means L includes a retaining plate 152 which is hinged to a sleeve 154. The sleeve 154 is, in turn, rigidly affixed to a center section of the outermost vertical gate member 156. The hinged retaining plate 152 has a slot or opening 158 formed in its end extending away from the vertical gate member 156. The opening 158 receives a collar 160 rigidly mounted on the wall 162 adjacent the window frame F. A locking shaft 164 can extend through a bore 166 in the collar 160 to hold the retaining plate 152 adjacent the wall 162 as illustrated in FIG. 10. A shaft retaining means S is provided on the wall 162 a sufficient distance from the window frame F to prevent a person from reaching through the window frame and retracting the shaft 164 from the collar 160. As illustrated in FIG. 10, the shaft retaining means may include a sleeve 166 rigidly affixed to the wall and providing an opening through which a lower end 168 of the shaft 164 may be extended. Preferably, a bore is formed through the shaft 164 at its lower portion so that a pin 170 can extend through a suitable opening in the sleeve 166 and the bore in the shaft 164. The pin 170 and sleeve 166 thus retain the locking shaft 164 in its desired position and prevent the shaft from being removed from the collar 160 by unauthorized personnel. Yet, the shaft 164 is readily removable by people within the room who might want to escape through the fire escape door in case of an emergency. Thus, the grille assembly A with the fire escape gate provides the desired security for the window to prevent unauthorized entry through the window, but at the same time allows personnel in the building with which the grille A is employed to escape in case of an emergency.

The foregoing disclosure and description of the invention are illustrative and explanatory thereof, and various changes in the size, shape, and materials as well as in the details of the illustrated construction may be made without departing from the spirit of the invention.

I claim:

1. A grille assembly mountable with a window frame for securing a window against unauthorized entry, comprising:

a plurality of horizontal members;

each of said horizontal members having a plurality of longitudinally spaced, vertical openings formed therein and extending therethrough, wherein said plurality of horizontal members include an upper horizontal member, a central horizontal member, and a lower horizontal member;

a plurality of vertical bars mounted with said horizontal members and extending into said vertical openings in said horizontal members, wherein (1) one of said vertical bars includes a midsection having a lateral dimension sufficiently large to prevent said midsection from passing through said vertical openings in at least one of said horizontal members, and a lower portion of said midsection engages one of said horizontal members so that said vertical bar is supported by such horizontal member, and (2) said vertical openings of said central horizontal member are sufficiently large to permit said midsection to pass through said central horizontal member but said lateral dimension of said midsection is sufficiently large to prevent said midsection from passing through said vertical openings in said lower horizontal member;

each of said horizontal members having a longitudinally extending bore in each of its ends, said bore extending inwardly from the end of said horizontal member to one of said vertical openings formed in said horizontal member;

a plurality of mounting assemblies mounted in said horizontal member bores;

each of said mounting assemblies including:

a piston slidably mounted in one of said horizontal member bores;

a pin mounted with said piston for protruding into a hole in a window frame; and resilient means engaging said piston and one of said vertical bars extending through said horizontal member for urging said piston and pin mounted therewith outwardly toward the window frame and securely engaging said pin in said window frame hole.

2. The structure set forth in claim 1, further including:

a friction washer affixed around one of said vertical bars, said washer having an outer diameter sufficiently large to prevent said washer from passing through said vertical openings in said horizontal members; and said washer engaging one of said horizontal members so that said engaged horizontal member supports said vertical bar around which said band is affixed.

3. The structure set forth in claim 1, further including:

a key mounted with one of said vertical bars and extending laterally therefrom a sufficient distance to prevent a portion of said vertical bar from passing through said vertical openings in said horizontal members when said key engages said horizontal members.

4. The structure set forth in claim 3, wherein:

said plurality of horizontal members includes an upper horizontal member and a lower horizontal member;

said key engages said lower horizontal member to support said vertical bar on said lower horizontal member; and said upper horizontal member has a plurality of slots being contiguous to one of said vertical openings in said upper horizontal member and having dimensions sufficient to permit said key to pass through said upper horizontal member for assembly of said vertical bars and horizontal members.

5. The structure set forth in claim 1, wherein:

said plurality of horizontal members include an upper horizontal member and a lower horizontal member;

a first key is mounted on one of said vertical bars and extends laterally therefrom;

a second key is mounted on said vertical bar longitudinally spaced from said first key; and said second key engages said lower horizontal member so that said vertical bar is supported on said lower horizontal member and said second key is in close proximity to said upper horizontal member to engage said upper horizontal member for preventing substantial upward vertical movement of said vertical bar.

6. The structure set forth in claim 5, wherein:

said plurality of horizontal members further include a center horizontal member mounted with said window frame and between said upper horizontal member and said lower horizontal member;

said central horizontal member having a plurality of slots formed therein, each of said slots being contiguous to one of said vertical openings in said central horizontal member and having dimensions sufficient to permit said keys to pass through said central horizontal member for assembly of said vertical bars and said horizontal members.

7. A grille assembly mountable with a frame for securing a window against unauthorized entry, comprising:

a plurality of horizontal members, wherein said plurality of horizontal members include an upper horizontal member and a lower horizontal member;

each of said horizontal members having a plurality of longitudinally spaced, vertical openings formed therein and extending therethrough;

a plurality of vertical bars extending into said vertical openings in said horizontal members;

a plurality of mounting assemblies for mounting said horizontal members with a window frame;

vertical support means for supporting at least one of said vertical bars, said vertical means including:

a sleeve for receiving a lower portion of said supported vertical bar;

a piston slidably received in said sleeve;

a pin mounted with said piston for extending into a hole formed in a sill of the window frame; and resilient means engaging said piston and a lower end of said supported vertical bar for supporting said vertical bar and urging said pin downwardly to securely engage said pin in said window sill hole, and wherein:

an upper portion of said supported vertical bar extends into one of the vertical openings in said upper horizontal member;

said resilient means urges said supported bar upwardly; and further including a key mounted on said supported vertical bar and extending laterally therefrom for engagement with said upper horizontal member in response to the upward urging of said resilient means on said supported vertical bar so that said supported vertical bar is firmly held against upward movement by said key and yieldably held against downward movement by said resilient means.

* * * * *